US007517062B2

(12) United States Patent
Matsumoto et al.

(10) Patent No.: US 7,517,062 B2
(45) Date of Patent: Apr. 14, 2009

(54) LIQUID DISCHARGE DEVICE

(75) Inventors: Ayumu Matsumoto, Kokubu (JP); Manabu Hibi, Nagoya (JP); Atsuo Sakaida, Nagoya (JP); Atsushi Hirota, Nagoya (JP)

(73) Assignees: Kyocera Corporation, Kyoto (JP); Brother Kogyo Kabushiki Kaisha, Aichi-Ken (JP)

( * ) Notice: Subject to any disclaimer, the term of this patent is extended or adjusted under 35 U.S.C. 154(b) by 254 days.

(21) Appl. No.: 11/096,710

(22) Filed: Mar. 31, 2005

(65) Prior Publication Data

US 2005/0248625 A1 Nov. 10, 2005

(30) Foreign Application Priority Data

Mar. 31, 2004 (JP) ..... 2004-103874

(51) Int. Cl.
*B41J 2/045* (2006.01)
*B41J 2/15* (2006.01)

(52) U.S. Cl. ..... 347/68; 347/40

(58) Field of Classification Search ..... 347/68–72, 347/40, 50; 310/365, 366
See application file for complete search history.

(56) References Cited

U.S. PATENT DOCUMENTS 5,146,236 A * 9/1992 Hirata et al. ..... 347/12
5,455,615 A * 10/1995 Burr et al. ..... 347/92
5,757,400 A * 5/1998 Hoisington ..... 347/40
6,422,690 B1 * 7/2002 Harvey et al. ..... 347/68
2003/0112298 A1 * 6/2003 Sato et al. ..... 347/68
2003/0156167 A1 * 8/2003 Sakaida et al. ..... 347/68
2005/0140747 A1 * 6/2005 Batterton et al. ..... 347/71

FOREIGN PATENT DOCUMENTS

| | | |
|---|---|---|
| EP | 1 138 493 | 10/2001 |
| JP | 11-034321 | 2/1999 |
| JP | 2003-154646 | 5/2003 |
| WO | 97/28000 | 8/1997 |

OTHER PUBLICATIONS

Chinese language office action and its English language translation for corresponding Chinese application 200510062779.0.

* cited by examiner

*Primary Examiner*—Stephen D Meier
*Assistant Examiner*—Geoffrey Mruk
(74) *Attorney, Agent, or Firm*—Hogan & Hartson LLP

(57) ABSTRACT

The present invention is directed at a liquid discharge device having reduced crosstalk, which slows the rate of change of liquid discharge speed, and is suitable as a printing head. The liquid discharge device includes a piezoelectric actuator and a flow passage member. The piezoelectric actuator has a plurality of driving electrodes from on a piezoelectric ceramic layer, and a plurality of piezoelectric displacement elements is disposed longitudinally and laterally with regularity. In the flow passage member, a plurality of liquid compressing chambers is formed with liquid outlet orifices. The piezoelectric actuator is placed on the flow passages member, so that the driving electrodes correspond in position to the liquid compressing chambers.

13 Claims, 6 Drawing Sheets

LIQUID DISCHARGE DEVICE

Priority is claimed to Japanese Patent Application No. 2004-103874 filed on Mar. 31, 2004, the disclosure of which is incorporated by reference in its entirety.

BACKGROUND OF THE INVENTION

1. Field of the Invention

The present invention relates to a liquid discharge device and, in particular, to a liquid discharge device suitable for printing heads that are used to recording apparatus of the following: various printers, recorders, facsimiles, or printers used for formation of patterns in the fields of textile printing and ceramic industry, or pumps that are used to precisely discharge and transfer liquid such as adhesive or ink, wherein characters and images are printed by discharging a drop of ink from a fine liquid outlet orifice.

2. Description of Related Art

Piezoelectric ceramics have been used in, for example, piezoelectric actuator, filter, piezoelectric resonator (including oscillator), ultrasonic oscillator, ultrasonic motor, piezoelectric sensor and pressure pump. Among these devices, the piezoelectric actuator is applied as the piezoelectric actuator for positioning an X-Y stage of semiconductor manufacturing equipment or as the piezoelectric actuator for liquid discharge device (printing head) of inkjet recording apparatus, by taking advantage of the very high response rate to electrical signals, in the order of $10^{-6}$ seconds.

As for liquid discharge device mounted to this ink-jet recording apparatus, the following systems are generally known: (1) Thermal head system, wherein a heater is prepared as a compressing tool within a liquid compressing chamber filled up with ink, and the heater heats and boils the ink so that bubbles can be generated within the liquid compressing chamber to compress the ink to discharge a drop of ink from a liquid outlet orifice; and (2) Piezoelectric system, wherein a certain portion of wall of a liquid flow passage with ink filled is bent and displaced by piezoelectric displacement elements of a piezoelectric actuator to mechanically compress the ink in a liquid compressing chamber, thereby discharging a drop of ink from a liquid outlet orifice.

Among these, the liquid discharge device that employs piezoelectric system is composed of a piezoelectric actuator wherein a plurality of piezoelectric displacement elements are formed and a flow passage member that has liquid inlet orifices, liquid compressing chambers and liquid outlet orifices. The piezoelectric actuator is placed on the flow passage member, so that the piezoelectric displacement elements correspond in position to the liquid compressing chambers. A plurality of piezoelectric displacement elements are formed from a piezoelectric ceramic layer that consists of perovskite piezoelectric ceramics containing Pb such as lead zirconate titanate (PZT), and electrodes that are disposed on the both sides of the piezoelectric ceramic layer. When driving voltage is applied from the both sides of the piezoelectric displacement elements, the piezoelectric displacement elements are displaced to discharge a fine drop of ink from the liquid outlet orifices (For example, Japanese Patent Application Laid-Open No. 11-34321).

Japanese Patent Application Laid-Open No. 2003-154646 proposes an ink-jet head wherein liquid compressing chambers are disposed in 4 to 10 lines, and dot density in sub-scanning direction is not less than 300 dpi (dots/inch) for one pass scanning of a head in main-scanning direction. This ink-jet head can contribute to miniaturization of ink-jet heads and higher dot density.

However, in the liquid discharge device according to Japanese Patent Application Laid-Open No. 2003-154646, since wiring (extraction electrodes) for applying driving voltage is passed between the neighboring piezoelectric displacement elements, when the piezoelectric displacement elements are too close, there is a risk that the piezoelectric displacement elements will touch the extraction electrodes, thus causing poor conduction. Further, when the neighboring piezoelectric displacement elements are too close, displacement of one piezoelectric displacement element induces another displacement of its neighboring piezoelectric displacement element, which influences discharge speed of ink drops, resulting in poor image quality. That means there is a problem that so-called cross talk has large influence.

Moreover, in the liquid discharge device according to Japanese Patent Application Laid-Open No. 2003-154646, when dot density is much higher (for example, from 300 dpi to 600 dpi), the area of driving portion in the piezoelectric displacement elements is made smaller to create spaces between the neighboring piezoelectric displacement elements, and the extraction electrodes in the neighboring lines are placed in these spaces. However, when the area of the driving portion is too smaller, displacement of the piezoelectric displacement elements is also smaller, and discharge speed of ink drops is lowered by cross talk influence, causing less accuracy of ink landing and poor image quality. Thus, higher dot density has limitation. Further, in order not to lower ink discharge speed, driving voltage needs to be high, which leads to an increase in power consumption.

SUMMARY OF THE INVENTION

The main advantage of the present invention is to provide a liquid discharge device that can suppress cross talk.

The present inventors, as a result of keen examination to solve the above problems, achieved the present invention by finding the following new fact, that is, when the number of lines N in piezoelectric displacement elements is set to not less than 4 and driving electrodes that compose the piezoelectric displacement elements are disposed in a predetermined condition, interval for disposing the piezoelectric displacement elements in each line is prevented from being excessively small, and a plurality of driving electrodes can be disposed in proper interval. Thereby, dot density in lateral direction can be kept in a high value of not less than 300 dpi and also cross talk generation can be suppressed.

The liquid discharge device of the present invention basically comprises a piezoelectric actuator wherein a plurality of driving electrodes are formed on a piezoelectric ceramic layer and a plurality of piezoelectric displacement elements are longitudinally and laterally disposed with regularity, and a flow passage member wherein a plurality of liquid compressing chambers with liquid outlet orifices are formed. The piezoelectric actuator is placed on the flow passage member, so that the driving electrodes correspond in position to the liquid compressing chambers. In the present invention, the piezoelectric displacement elements are longitudinally disposed in N lines ($N \geqq 24$), and the dot density in the lateral direction is not less than 300 dpi. The ratio (B/A) of arrangement interval B between the driving electrodes in the longitudinal direction to arrangement interval A between the driving electrodes in the lateral direction is 0.95 to 1.5. In addition, the minimum distance "D" between the neighboring driving electrodes is 0.15 A or more, i.e., $D \geqq 0.15$ A.

That is, since the piezoelectric displacement elements are disposed as above, high dot density can be obtained, and cross talk can be suppressed by preventing the neighboring piezoelectric displacement elements from being too close. By preventing the neighboring piezoelectric displacement elements from being too close, it is also possible to avoid poor conduction that results from such that the piezoelectric displacement elements touch the neighboring wiring. Furthermore, since the piezoelectric displacement elements can be effectively disposed, arrangement interval between the piezoelectric displacement elements is prevented from being excessively wide, thus avoiding larger liquid discharge devices.

The piezoelectric displacement elements in the present invention may be disposed at a rate of 20 to 120 pieces/inch in each line. In addition, the piezoelectric displacement elements are disposed in hound's-tooth check pattern, and the ratio (Y/X) of length Y in the lateral direction to length X in the longitudinal direction in the piezoelectric actuator is not less than 1.2.

Examples of the piezoelectric actuator mounted to the liquid discharge device of the present invention include a laminated body wherein a common electrode, a piezoelectric ceramic layer, and a driving electrode are laminated on a diaphragm in this order. In this laminated body, a piezoelectric displacement element is composed of the common electrode, the driving electrode and the piezoelectric ceramic layer between these electrodes.

By using such piezoelectric actuator, thickness of the portion that comprises a common electrode, a piezoelectric ceramic layer and a driving electrode becomes small, and total thickness including a diaphragm also becomes small. Therefore, large displacement can be obtained, even if $d_{31}$ vibration mode is used.

DETAILED DESCRIPTION OF THE PREFERRED EMBODIMENTS

Figure 1:
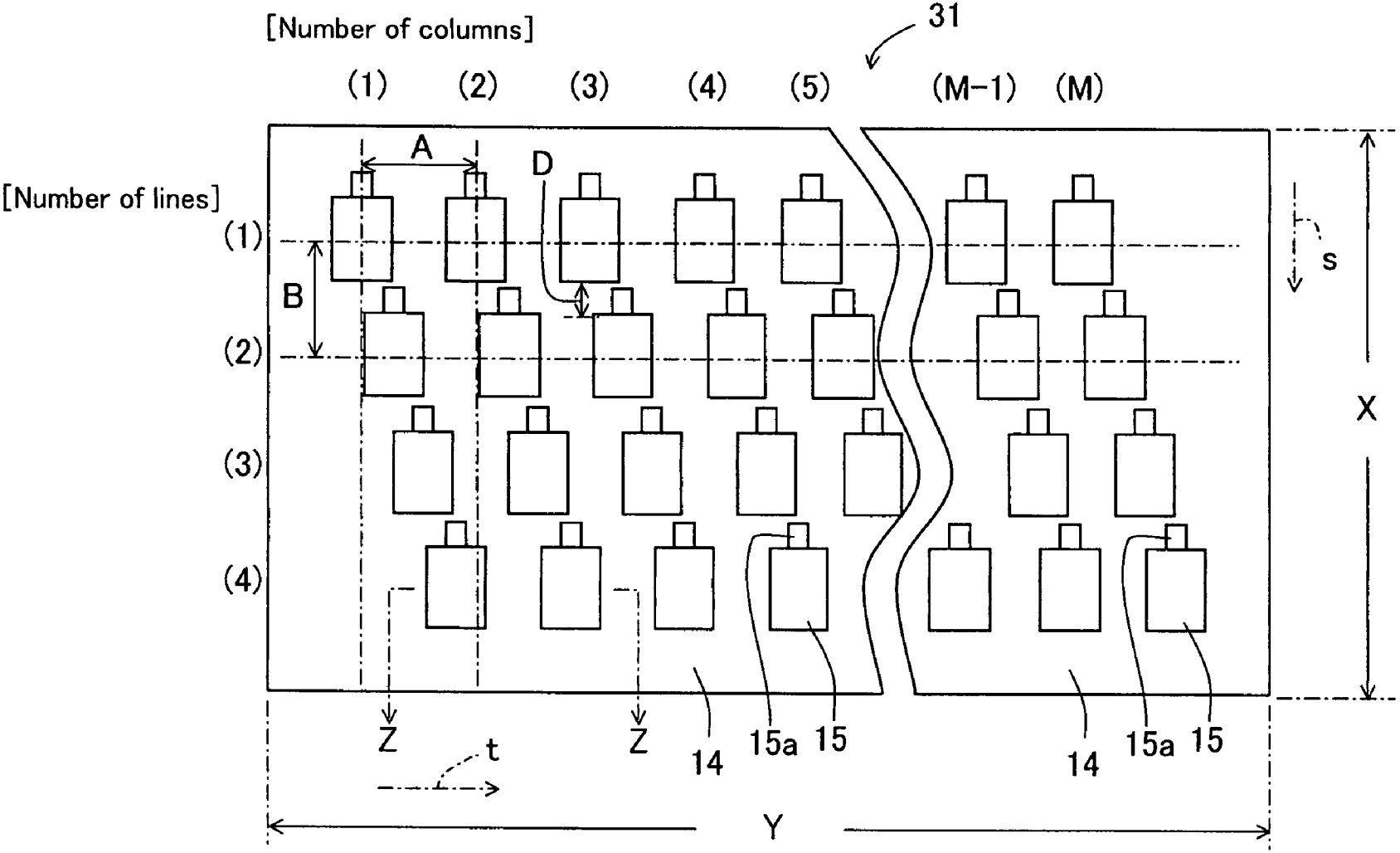
FIG. 1 is a plan view showing a printing head in one embodiment of the present invention.
Figure 2:
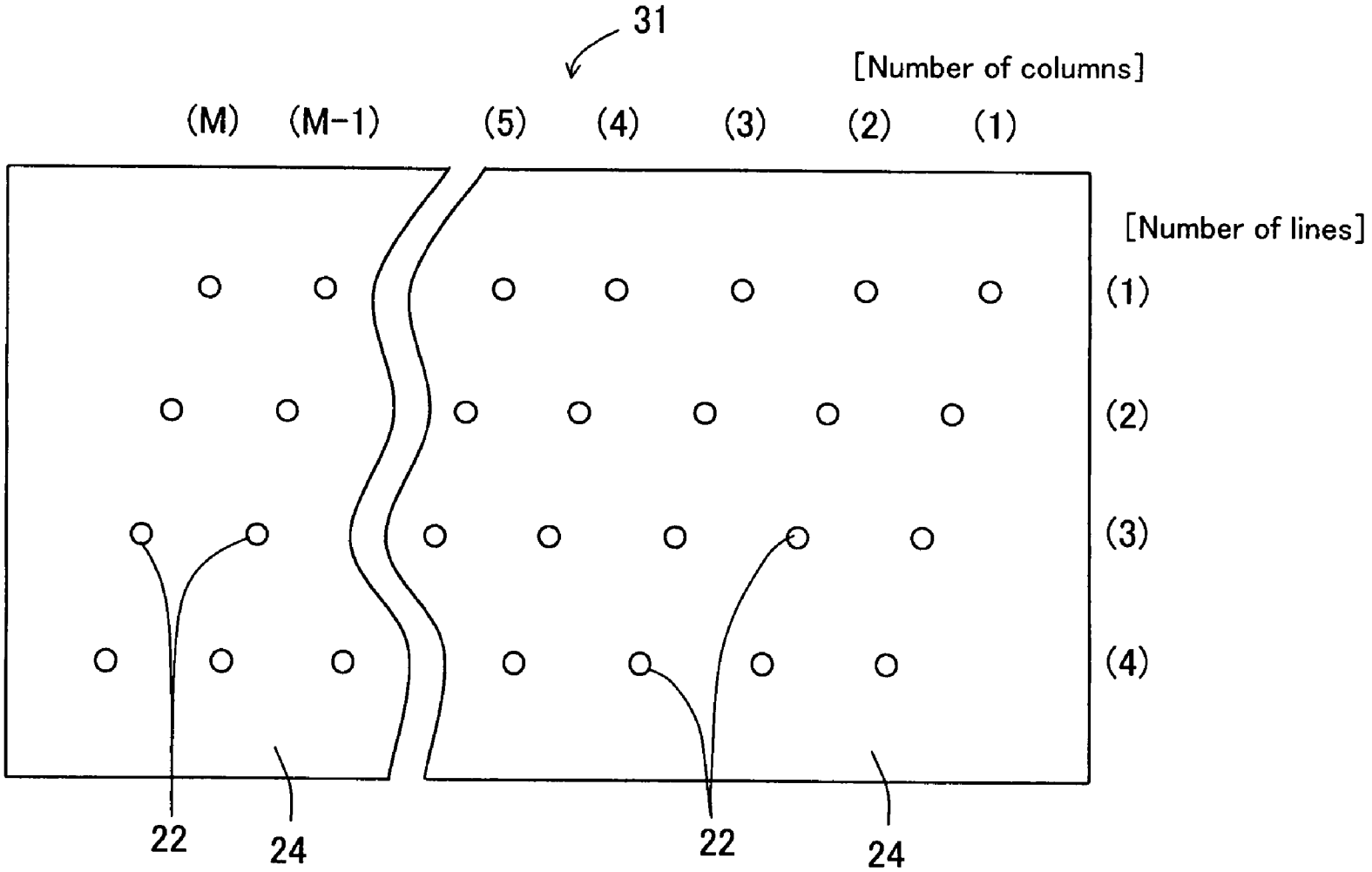
FIG. 2 is a bottom view showing a printing head in one embodiment of the present invention.
Figure 3:
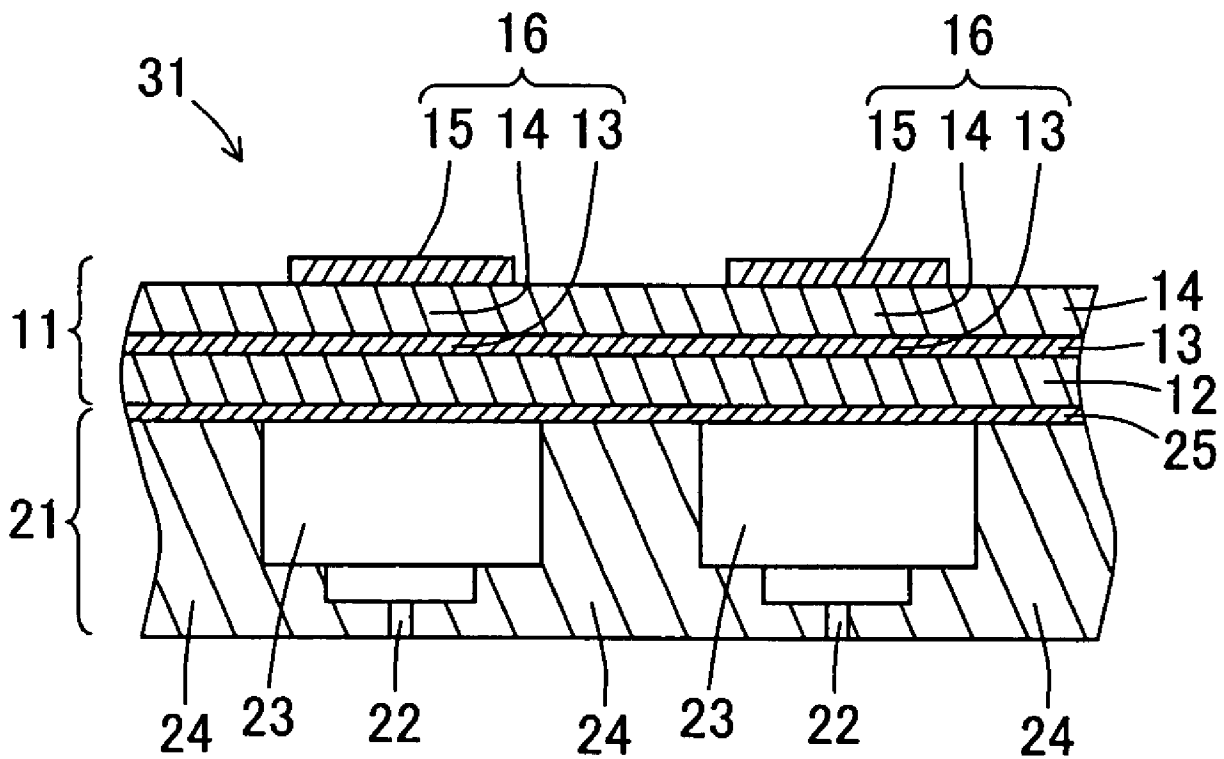
FIG. 3 is a sectional view taken along the line Z-Z in FIG. 1.

The liquid discharge device of the present invention will be now described in detail, taking the application of an ink-jet printing head for instance and referring to the figures. FIG. 1 is a plan view showing a printing head in one embodiment of the present invention, and FIG. 2 is the bottom view of FIG. 1. FIG. 3 is a sectional view taken along the line Z-Z in FIG. 1.

As shown in FIG. 3, a printing head (liquid discharge device) 31 is composed of a piezoelectric actuator 11 and a flow passage member 21. The flow passage member 21 has a plurality of liquid compressing chambers 23 with liquid outlet orifices 22. The piezoelectric actuator 11 is bonded on the flow passage member 21 with an adhesive layer 25, so that driving electrodes 15 correspond in position to the liquid compressing chambers 23.

The piezoelectric actuator 11 is composed of a laminated body wherein a common electrode 13, a piezoelectric ceramic layer 14 and driving electrodes 15 are laminated on a diaphragm 12 in this order. By taking this form, large displacement can be obtained, even if $d_{31}$ vibration mode is used. As shown in FIG. 1, a land part 15*a* is prepared at one end of each driving electrode 15 so that external wiring can be connected to apply driving voltage. Each liquid compressing chamber 23 is separated by a partition wall 24.

In this piezoelectric actuator 11, a plurality of piezoelectric displacement elements 16 that are composed of the common electrode 13, the driving electrode 15 and the piezoelectric ceramic layer 14 positioned between these electrodes, are longitudinally and laterally disposed in hound's-tooth check pattern. The piezoelectric displacement elements 16 are disposed, longitudinally in N lines (N=4 in FIG. 1 and FIG. 2,) and laterally in M columns. Each liquid compressing chamber 23 in the flow passage member 21 is disposed in the position corresponding to each piezoelectric displacement element 16. The liquid outlet orifice 22 is formed in the approximately central vicinity of each liquid compressing chamber 23. As shown in FIG. 2, the liquid outlet orifices 22 are longitudinally and laterally disposed in hound's-tooth check pattern on the bottom side of the printing head 31.

By applying voltage between the common electrode 13 and the driving electrode 15, each piezoelectric displacement element 16 is flexibly transformed together with the diaphragm 12 to apply pressure on the inside of the liquid compressing chamber 23. Thereby, ink that is introduced into the liquid compressing chamber 23 through the liquid inlet orifice (not shown in the figures) is pressured, so that a drop of ink can be discharged from the liquid outlet orifice 22.

The printing head 31 is applicable to both serial scan head and line scan head. When the printing head 31 is used as a serial scan head, longitudinal direction (direction S) and its opposite direction are main-scanning direction of the printing head 31. Sub-scanning direction (direction t) which is vertical to the main-scanning direction is a scanning direction of recording medium (e.g. printing paper). On the other hand, when the printing head 31 is used as a line scan head, longitudinal direction is a main-scanning direction of recording medium, and the printing head 31 is fixed. The number of columns M may be properly set, depending on head type (serial scan head or line scan head), the maximum size of recording medium and the like. The number of lines N is not less than 4, preferably, 4 to 150.

The liquid discharge device of the present invention is characterized in that the number of lines N of piezoelectric displacement elements is not less than 4; the resolution in lateral direction (dot density) is not less than 300 dpi, preferably, not less than 600 dpi; the ratio (B/A) of arrangement interval B between the driving electrodes 15 in longitudinal direction to arrangement interval A between the driving electrodes 15 in lateral direction is 0.95 to 1.5; and further the minimum distance D between the neighboring driving electrodes 15 is 0.15 A or more, that is $D \geqq 0.15A$.

For example, when the number of lines N is 4 as in the above printing head 31, the piezoelectric displacement elements 16 need to be disposed at intervals of 75 pieces/inch in each line, so that one scanning in longitudinal direction achieves printing at 300 dpi resolution in lateral direction. That is, the arrangement interval A between the driving electrodes 15 disposed in lateral direction is formed at intervals of 0.3387 mm (25.4/75=0.3387). Here, "one scanning in longitudinal direction" means that in case of serial scan head, the printing head 31 scans once in direction S, while in case of line scan head, recording medium scans in direction S.

Thus, when the number of lines N is 4, the piezoelectric displacement elements 16 are disposed at the rate of 75 pieces/inch in each line. But according to variations in the number of lines N and/or in resolution in lateral direction, the piezoelectric displacement elements 16 can be disposed at a different rate in each line. The piezoelectric displacement elements 16 may be disposed preferably at the rate of 20 to 120 pieces/inch in each line, and more preferably at the rate of 20 to 90 pieces/inch. In this case, resolution in sub-scanning direction at which one scanning in direction S can print in each line is 20 dpi (dot interval 1.27 mm) to 90 dpi (dot interval 0.28 mm). Thereby, a pitch between electrodes does not need to be made excessively larger, and thus the liquid discharge device can be manufactured at low cost and easily, using conventional process. That means, since the interval between the neighboring piezoelectric displacement elements can be larger, conventional low-cost methods of forming pressure membrane electrodes such as screen printing method may be applicable.

On the other hand, the arrangement interval B between the driving electrodes 15 in longitudinal direction can be set, so that the value of the ratio (B/A) can be controlled within the above range. For example, when the piezoelectric displacement elements 16 are evenly disposed in longitudinal and lateral directions, the arrangement interval B may be 0.3387 mm, which is the same value as the arrangement interval A in lateral direction (the ratio B/A=1). As the arrangement interval B is excessively small, the piezoelectric displacement elements 16 in the neighboring line become too close, and thus influence of cross talk becomes larger. On the contrary, as the arrangement interval B is excessively larger and the ratio of B/A is over 15, length of the printing head 31 in longitudinal direction becomes larger, and thus the printing head becomes larger, which makes handling and maintenance difficult. Moreover, it is important that each driving electrode 15 is disposed so that the minimum distance D between the neighboring driving electrodes can keep 0.15 A or more, that is $D \geqq 0.15$ A. This is because influence of cross talk can be smaller and miniaturization of a printing head can be achieved.

In addition, in the piezoelectric actuator 11, the ratio of length Y in lateral direction to length X in longitudinal direction (Y/X) may be not less than 1.2, preferably, not less than 2. This can contribute to miniaturization of the printing head 31, even when a line scan head is composed of a plurality of piezoelectric actuators 11 disposed in sub-scanning direction that is vertical to the main-scanning direction of recording medium.

The piezoelectric ceramic layer 14 can be made of a ceramic material that shows piezoelectricity, specifically Bi layered compound (layer perovskite compound), tungsten-bronze compound and a material containing perovskite compound such as Nb-based perovskite compound (e.g., alkali niobate compound (NAC) such as sodium niobate, and alkali earth niobate compound (NAEC) such as barium niobate), lead magnesium niobate (PMN-based compound), lead nickel niobate (PNN-based compound), lead zirconate titanate (PZT) containing Pb, and lead titanate.

Among these materials, in particular, a perovskite compound containing at least Pb is preferable. Specifically, a material that contains lead magnesium niobate (PMN-based compound), lead nickel niobate (PNN-based compound), lead zirconate titanate (PZT) containing Pb and lead titanate is preferable. A crystal containing Pb as a constituent element at site A and containing Zr and Ti as constituent elements at site B is especially preferable. With this composition, the piezoelectric ceramic layer 14 that has a high piezoelectric constant can be obtained. Among these materials, lead zirconate titanate containing Pb and lead titanate are preferable for adding large displacement.

As an example of the above perovskite crystal, $PbZrTiO_3$ can be preferably used. It is possible to mix other oxides, and other elements as auxiliary components may be substituted at site A and/or site B as far as characteristics are not adversely affected. For example, solid solution of $Pb(Zn_{1/3}Sb_{2/3})O_3$ and $Pb(Ni_{1/2}Te_{1/2})O_3$ that have Zn, Sb, Ni and Te added as auxiliary components is preferable.

It is preferable to further include an alkali earth element as the constituent element at site A in the above perovskite crystal. Examples of the alkali earth element include Ba, Sr and Ca, and in particular Ba and Sr are preferable in achieving greater displacement. Consequently, relative dielectric constant is improved, thus making it possible to obtain a higher piezoelectric constant.

Specifically, for example, a compound having a composition of $Pb_{1-x-y}Sr_xBa_y$ $$(Zn_{1/3}Sb_{2/3})_a(Ni_{1/2}Te_{1/2})_bZr_{1-a-b-c}Ti_cO_3+\alpha \text{ wt \% } Pb_{1/2}NbO_3$$

(In the above formula, $0 \leqq x \leqq 0.1$,
$0.1 \leqq y \leqq 90$,
$0.1 \leqq a \leqq 90.05$,
$0.002 \leqq b \leqq 0.01$,
$0.44 \leqq c \leqq 0.50$,
$\alpha=0.1\sim1.0$)

may be used. Though thickness of the piezoelectric ceramic layer 14 is not limited specifically, it may be not more than 30 μm, preferably not more than 20 μm and more preferably 8 to 15 μm.

Though material of the diaphragm 12 is not limited specifically, for example, metal elements such as molybdenum, tungsten, tantalum, titanium, platinum, iron and nickel, metal alloys of these metals, metal materials such as stainless steel, or ceramics such as zirconia and PZT can be used. In particular, it is preferable that the diaphragm 12 and the piezoelectric ceramic layer 14 are composed of the same material. Furthermore, it is preferable that the diaphragm 12 is fired and united with the common electrode 13 and the piezoelectric ceramic layer 14. Thus, curvative deformation caused in the piezoelectric ceramic layer 14 can be corrected.

As a material of the common electrode 13, one or a combination of not less than two selected from Ag, Pd, Pt, Rh, Au and Ni-based materials are preferably used. In particular, Ag—Pd based alloy is more preferable. Thickness of the common electrode 13 has conducting properties and preferably it is not so large as to prevent displacement, e.g. 0.5 to 8 μm, more preferably 1 to 3 μm.

As a material of the driving electrode 15 and the land part 15*a*, for example, the same metals as in the above-mentioned common electrode 13 can be used. However, preferably, Au that is excellent in electric resistance and corrosion resistance is used. Thickness of the driving electrode 15 and the land part 15*a* is 0.3 to 5 μm, preferably 0.5 to 2 μm.

Though total thickness of the piezoelectric actuator 11 is not limited specifically, it may be not more than 100 μm, preferably not more than 80 μm, more preferably not more than 65 μm and most preferably not more than 50 μm. On the other hand, the lower limit of thickness is 3 μm, preferably 5 μm, more preferably 10 μm and most preferably 20 μm so as to achieve sufficient mechanical strength to prevent breakage during handling and operation.

The method of manufacturing the piezoelectric actuator 11 will be now described. First, using powder of the piezoelectric ceramics, a required number of green sheets are formed. On the approximately whole surface of some green sheets, common electrode patterns are formed. A laminated body is formed by laminating green sheets so that the common electrode patterns can be interposed between the green sheets with the common electrode patterns formed and other green sheets. Then, after cutting this laminated body in a predetermined form, the main body of the piezoelectric actuator is formed by firing at 900 to 1100° C. Lastly, a conductive paste is printed on the surface of this piezoelectric actuator to form driving electrode patterns and land part patterns in a predetermined position, and firing is performed at 600 to 850° C. Thereby, the piezoelectric actuator 11 can be obtained. The driving electrode and the land part can be fired at the same time with the piezoelectric ceramic layer and the common electrode.

The method of manufacturing the printing head 31 will be described as follows. The flow passage member 21 is obtained by rolling process. The liquid outlet orifice 22 and the liquid compressing chamber 23 are prepared by processing into a predetermined form with etching. Preferably, this flow passage member 21 is made of at least one material selected from Fe—Cr, Fe—Ni, and WC—TiC based materials, and in particular, a material that is excellent in corrosion resistance against ink. Fe—Cr based material is more preferable.

The piezoelectric actuator 11 and the flow passage member 21, for example, can be laminated and bonded via the adhesive layer 25. The adhesive layer 25 can be made of a well-known material. However, to avoid influence on the piezoelectric actuator 11 and the flow passage member 21, at least one thermosetting adhesive selected from epoxy resin, phenol resin and polyphenylene ether resin that have a thermosetting temperature of 100 to 250° C. may be applicable. Using this adhesive layer 25, the piezoelectric actuator 11 and the flow passage member 21 can be bonded by heating the adhesive layer 25 to a thermosetting temperature. Thereby, the printing head 31 can be obtained.

Figure 4:
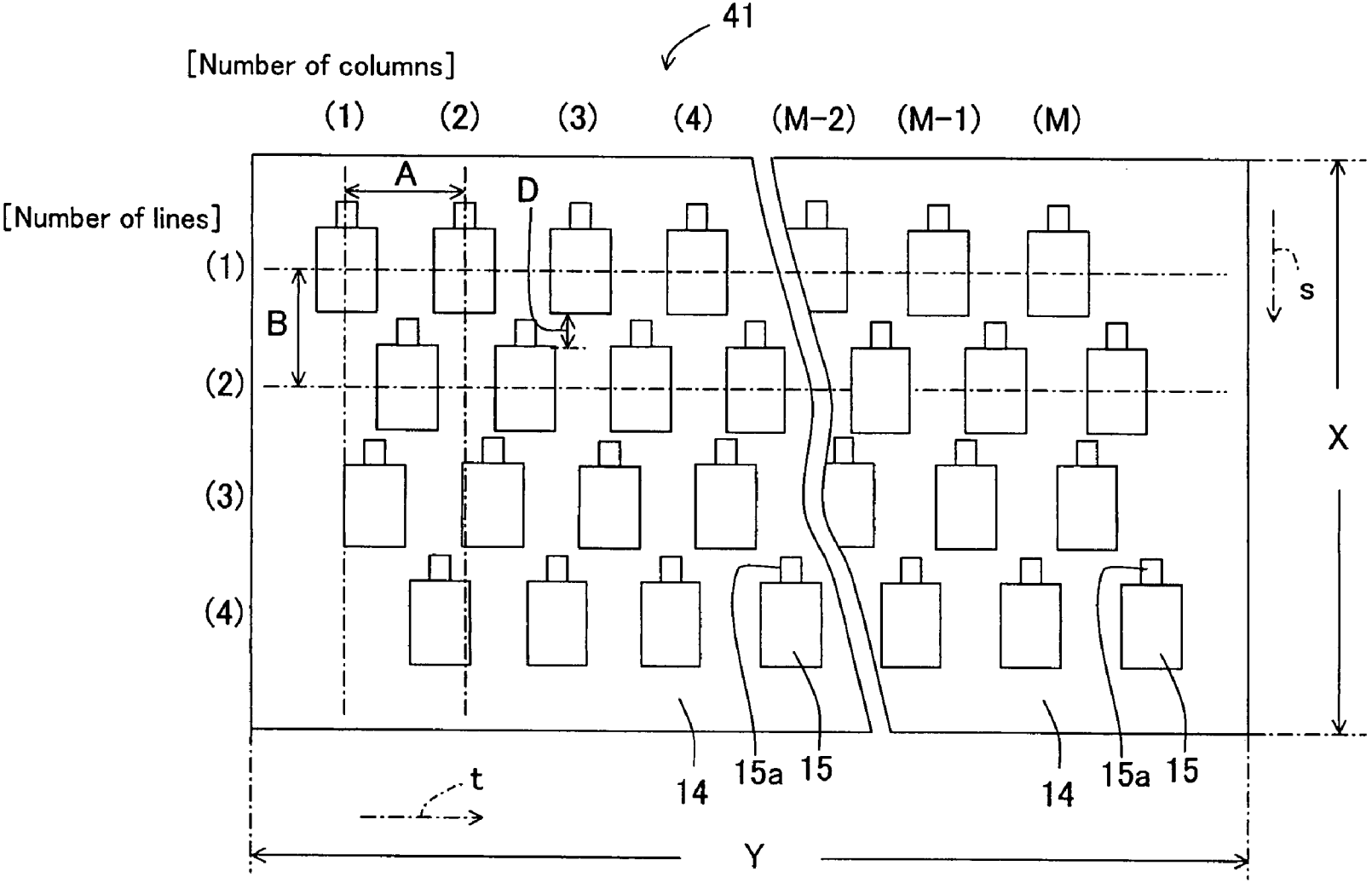
FIG. 4 is a plan view showing a printing head in another embodiment of the present invention.

FIG. 4 is a plan view showing a printing head in another embodiment of the present invention. The printing head 41 has the same composition as the above-mentioned printing head 31, except that arrangement of the piezoelectric displacement elements is different. In this printing head 41, a plurality of piezoelectric displacement elements that is composed of the driving electrode 15, the common electrode and the piezoelectric ceramic layer 14 between these electrodes, are disposed longitudinally and laterally in hound's-tooth check pattern as shown in FIG. 4. Also in this printing head 41, the ratio(B/A) of arrangement interval B between the driving electrodes 15 in longitudinal direction to arrangement interval A between the driving electrodes 15 in lateral direction is 0.95 to 1.5. The minimum distance D between the neighboring driving electrodes 15 keeps 0.15 A or more, that is $D \geqq 0.15$ A. As for other components, description is omitted, putting the same symbols as in FIG. 1.

Figure 5:
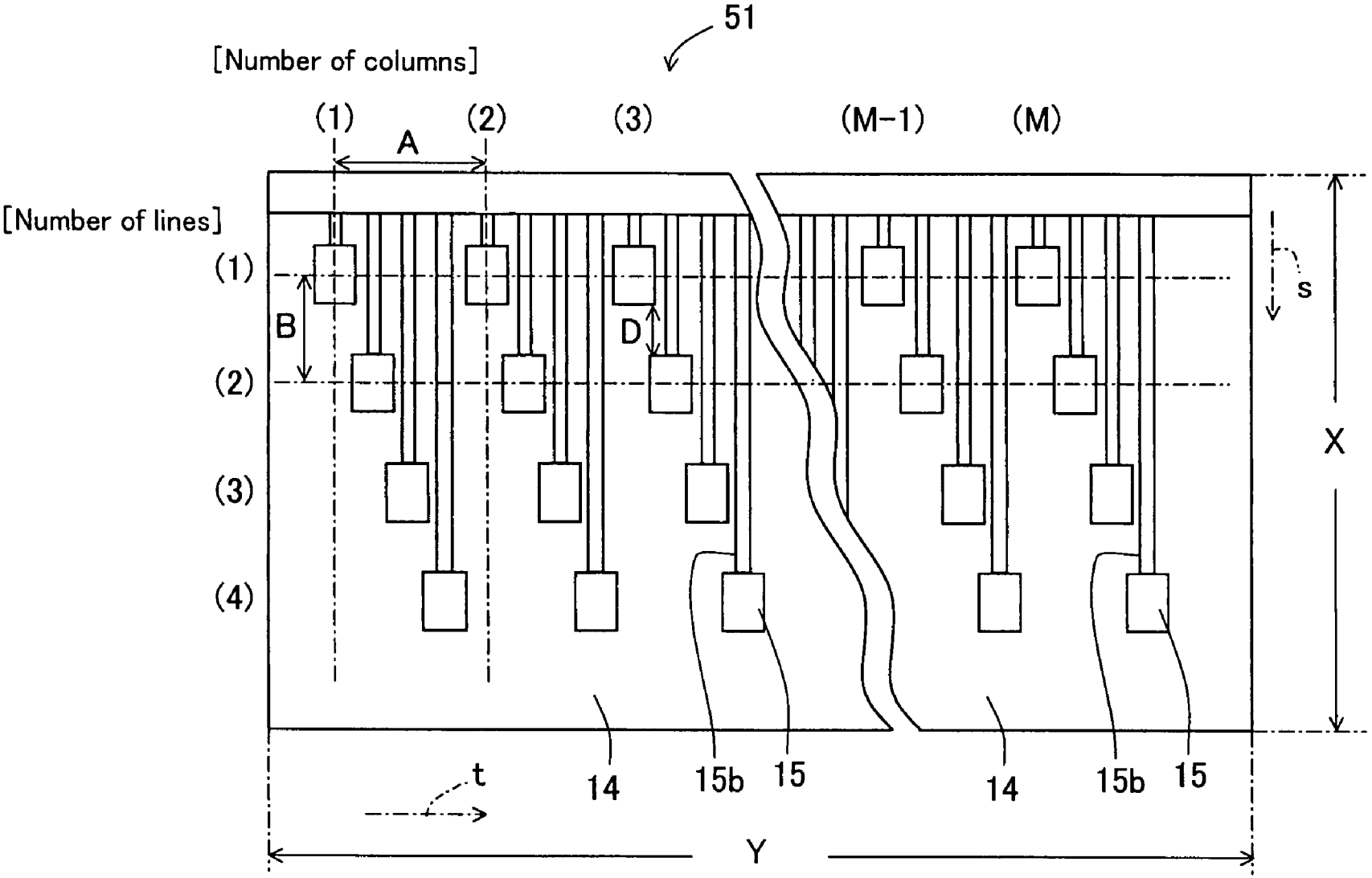
FIG. 5 is a plan view showing a printing head in the other embodiment of the present invention.

FIG. 5 is a plan view showing a printing head in the other embodiment of the present invention. In this printing head 51, the extraction electrodes 15*b* for applying driving voltage are respectively connected to one end of the driving electrode 15. Each extraction electrode 15*b* is extended to the end of the piezoelectric actuator 11. Thereby external wiring is facilitated. Also in this printing head 51, the ratio (B/A) and the minimum distance D satisfy the above-mentioned conditions. As for other components, description is omitted, putting the same symbols as in FIG. 1.

In such a form that the extraction electrodes are extended to the end of the piezoelectric actuator as shown in FIG. 5, for example, it is preferable that approximately half of the extraction electrodes are extended to the one end of the piezoelectric actuator, while the rest of the extraction electrodes to the other end of the piezoelectric actuator. Thus, by dividing extending direction of the extraction electrodes in two, cross talk that results from the extraction electrodes can be suppressed and the interval between the neighboring piezoelectric displacement elements becomes small, which can contribute to miniaturization of printing heads.

Figure 6:
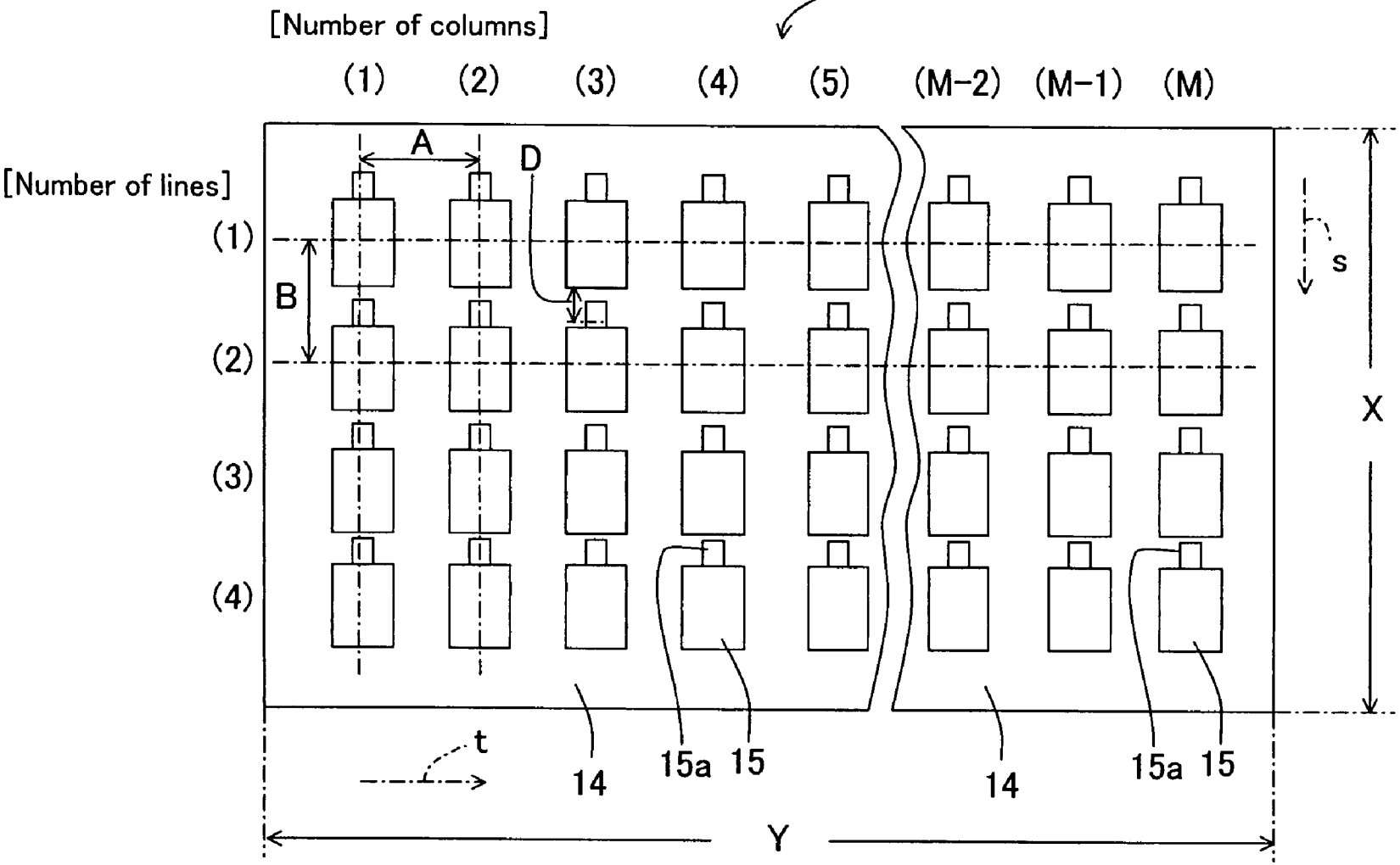
FIG. 6 is a plan view showing a printing head in the other embodiment of the present invention.

FIG. 6 is a plan view showing a printing head in the other embodiment of the present invention. The printing head 61 has the same composition as the above-mentioned printing head 31, except that arrangement of the piezoelectric displacement elements is different. In this printing head 61, a plurality of piezoelectric displacement elements are disposed longitudinally and laterally in lattice pattern as shown in FIG. 6. Also in this printing head 61, the ratio (B/A) and the minimum distance D satisfy the above-mentioned conditions. In the printing head 61, it is preferable to adjust a forming position of each liquid outlet orifice in each line so that the liquid outlet orifices of the flow passage member can be disposed in hound's-tooth check pattern as shown in FIG. 2. As for other components, description is omitted, putting the same symbols as in FIG. 1.

When the embodiment wherein a land part is prepared at one end of the driving electrode as shown in FIG. 1, FIG. 4 and FIG. 6 is compared to the embodiment wherein an extraction electrode is extended from one end of the driving electrode to the end of the piezoelectric actuator as shown in FIG. 5, the latter embodiment (FIG. 5) needs the extraction electrodes which are passed through the neighboring piezoelectric displacement elements. Therefore, as dot density is higher, the interval between the piezoelectric displacement elements becomes narrow. Accordingly, as technical difficulty in manufacturing is greater, manufacturing process becomes complicated. And manufacturing sometimes requires more cost than in the former embodiment (FIG. 1, FIG. 4 and FIG. 6). In the former embodiment, conventional manufacturing process such as screen printing can be used. Consequently, the former embodiment can be manufactured at lower cost and more easily than the latter one.

The above embodiments exemplify the case where the piezoelectric actuator is a laminated body wherein the common electrode, the piezoelectric ceramic layer, and the driving electrode are laminated on the diaphragm in this order. In the present invention, however, conductor layers and piezoelectric ceramic layers may be laminated one by one or in plural layers each. In this case, it is preferable that the conductor layers and the common electrodes are electrically connected. This makes it possible to lower electricity loss caused by piezoelectric vibration of the diaphragm that is induced and generated by displacement of the piezoelectric ceramic layer. It is preferable that the conductor layer, the common electrode and the piezoelectric ceramic layer are disposed symmetrically along the thickness direction of the laminated body. Thereby, warp during firing can be prevented.

The above embodiments exemplify the case where the liquid discharge device of the present invention is applied to a printing head. However, besides printing heads, the liquid discharge device of the present invention is applicable to, for example, pumps that are used to precisely discharge and transfer liquid such as adhesive and ink.

Examples of the present invention will be described below. It is understood, however, that the examples are for the purpose of illustration and the invention is not to be regarded as limited to any of the specific materials or condition therein.

EXAMPLES

Example 1

First, as a raw material, piezoelectric ceramics powder containing lead zirconate titanate having purity of not less than 99.9% was prepared and mill-ground by the use of a zirconia ball of its diameter ϕ2 mm and adjusted so that the mean particle size can be 0.3 to 0.5 μm. After drying, material powder was obtained by passing through mesh.

Then, by forming the obtained material powder, green sheets were prepared and common electrode paste was also prepared. The common electrode paste was printed 4 μm thick on the surface of some green sheets to prepare common electrodes. The green sheets with common electrodes printed and the green sheets with no printed common electrode paste were laminated and compressed to prepare a laminated green body. By firing this laminated green body, the main body of a piezoelectric actuator was obtained. On the surface of the main body of the piezoelectric actuator so obtained, a plurality of driving electrodes were formed. Au paste was applied on the driving electrodes by screen printing. Thereby, number of lines N, number of columns M, dot density, arrangement interval A, arrangement interval B, length in longitudinal direction X, length in lateral direction Y and arrangement pattern (lattice or hound's-tooth check) were set as mentioned in Table 1. By firing the driving electrodes at a temperature of 900 to 800° C. in the air atmosphere, a piezoelectric actuator was obtained.

By bonding the obtained piezoelectric actuator to a flow passage member, a liquid discharge device (printing head) was obtained. Liquid compressing chambers of the flow passage member were disposed so as to correspond in position to piezoelectric displacement elements of the piezoelectric actuator. The flow passage member was made up of SUS316. The piezoelectric actuator and the flow passage member were bonded, using epoxy adhesive and heating at 150° C. for four hours.

Regarding each liquid discharge device, performance evaluation was conducted as follows. Using each liquid discharge device, while a drop of liquid was continuously discharged, discharge speed of liquid drop was checked. Specifically, by providing electricity of 10 kHz drive frequency and 30V voltage between driving electrode and common electrode of the piezoelectric actuator, liquid in the liquid compressing chambers was compressed. Discharge speed of liquid drop from liquid outlet orifices was measured by a high-speed video camera and a stroboscope. Discharge speed was calculated as follows: when the luminescence interval of the stroboscope is taken to be, for example, 1 second, the distance of how far liquid drop moved was measured on the monitor image taken by a video camera; and the obtained distance was divided by the luminescence interval.

Cross talk influence mentioned in Table 1 was evaluated, based on rate of change of the discharge speeds, that is, the following discharge speed measured as mentioned in the above; (1) the discharge speed when all piezoelectric displacement elements were driven at the same time; and (2) the discharge speed when one piezoelectric displacement element was driven alone. The rate of change was calculated as follows: the discharge speed when all piezoelectric displacement elements were driven was subtracted from the discharge speed when one piezoelectric displacement element was driven alone; and the value so obtained was divided by the discharge speed when one piezoelectric displacement element was driven alone, and then multiplied by 100. In "Cross talk influence" of Table 1, "○" was marked when the rate of change so obtained was not more than 15%, and "X" was marked when the rate of change so obtained was not less than 16%. The overall evaluation was mentioned in "Evaluation". The results are presented in Table 1.

TABLE 1

| | | Piezoelectric Actuator | | | | | | | | |
|---|---|---|---|---|---|---|---|---|---|---|
| | Sample No. | N Line | Line Density pcs/inch | M Column | Arrangement Pattern (1) | Dot Density dpi | X | Y | Y/X | A mm |
| * | 1 | 3 | 100 | 100 | L | 300 | 0.762 | 25.908 | 34.0 | 0.254 |
| | 2 | 4 | 75 | 75 | L | 300 | 1.355 | 26.416 | 19.5 | 0.339 |
| | 3 | 5 | 60 | 60 | L | 300 | 2.117 | 27.093 | 12.8 | 0.423 |
| | 4 | 10 | 30 | 30 | L | 300 | 8.467 | 33.020 | 3.9 | 0.847 |
| | 5 | 15 | 20 | 20 | L | 300 | 19.050 | 43.180 | 2.3 | 1.270 |
| | 6 | 30 | 10 | 10 | L | 300 | 76.200 | 99.060 | 1.3 | 2.540 |
| * | 7 | 3 | 100 | 100 | H | 300 | 0.762 | 25.908 | 34.0 | 0.254 |
| | 8 | 4 | 75 | 75 | H | 300 | 1.355 | 26.416 | 19.5 | 0.339 |
| | 9 | 5 | 60 | 60 | H | 300 | 2.117 | 27.093 | 12.8 | 0.423 |
| | 10 | 10 | 30 | 30 | H | 300 | 8.467 | 33.020 | 3.9 | 0.847 |
| | 11 | 15 | 20 | 20 | H | 300 | 19.050 | 43.180 | 2.3 | 1.270 |
| | 12 | 30 | 10 | 10 | H | 300 | 76.200 | 99.060 | 1.3 | 2.540 |
| * | 13 | 5 | 60 | 60 | H | 300 | 1.482 | 27.093 | 18.3 | 0.423 |
| * | 14 | 5 | 60 | 60 | H | 300 | 1.905 | 27.093 | 14.2 | 0.423 |
| | 15 | 5 | 60 | 60 | H | 300 | 2.011 | 27.093 | 13.5 | 0.423 |
| | 16 | 5 | 60 | 60 | H | 300 | 2.117 | 27.093 | 12.8 | 0.423 |
| | 17 | 5 | 60 | 60 | H | 300 | 2.328 | 27.093 | 11.6 | 0.423 |
| | 18 | 5 | 60 | 60 | H | 300 | 2.540 | 27.093 | 10.7 | 0.423 |
| | 19 | 5 | 60 | 60 | H | 300 | 2.752 | 27.093 | 9.8 | 0.423 |
| | 20 | 5 | 60 | 60 | H | 300 | 2.963 | 27.093 | 9.1 | 0.423 |
| | 21 | 5 | 60 | 60 | H | 300 | 3.175 | 27.093 | 8.5 | 0.423 |
| * | 22 | 5 | 60 | 60 | H | 300 | 3.387 | 27.093 | 8.0 | 0.423 |
| * | 23 | 3 | 120 | 120 | H | 360 | 0.635 | 25.823 | 40.7 | 0.212 |
| | 24 | 4 | 90 | 90 | H | 360 | 1.129 | 26.247 | 23.3 | 0.282 |
| | 25 | 6 | 60 | 60 | H | 360 | 2.540 | 27.517 | 10.8 | 0.423 |
| | 26 | 12 | 30 | 30 | H | 360 | 10.160 | 34.713 | 3.4 | 0.847 |

TABLE 1-continued

| | | | | | | | | | |
|---|---|---|---|---|---|---|---|---|---|
| 27 | 18 | 20 | 20 | H | 360 | 22.860 | 46.990 | 2.1 | 1.270 |
| 28 | 36 | 10 | 10 | H | 360 | 91.440 | 114.300 | 1.3 | 2.540 |
| * 29 | 5 | 60 | 60 | H | 300 | 2.117 | 27.093 | 12.8 | 0.423 |
| 30 | 5 | 60 | 60 | H | 300 | 2.117 | 27.093 | 12.8 | 0.423 |
| 31 | 5 | 60 | 60 | H | 300 | 2.117 | 27.093 | 12.8 | 0.423 |
| 32 | 5 | 60 | 60 | H | 300 | 2.117 | 27.093 | 12.8 | 0.423 |
| 33 | 5 | 60 | 60 | H | 300 | 2.117 | 27.093 | 12.8 | 0.423 |
| 34 | 5 | 60 | 60 | H | 300 | 2.117 | 27.093 | 12.8 | 0.423 |
| 35 | 5 | 60 | 60 | H | 300 | 2.117 | 27.093 | 12.8 | 0.423 |
| 36 | 5 | 120 | 120 | H | 600 | 1.270 | 26.247 | 20.7 | 0.212 |
| 37 | 6 | 100 | 100 | H | 600 | 1.829 | 26.670 | 14.6 | 0.254 |
| 38 | 10 | 120 | 120 | H | 1200 | 2.540 | 27.305 | 10.8 | 0.212 |
| 39 | 12 | 100 | 100 | H | 1200 | 3.658 | 28.194 | 7.7 | 0.254 |

| | Piezoelectric Actuator | | | | Liquid Discharge Speed | | | | |
|---|---|---|---|---|---|---|---|---|---|
| Sample No. | B mm | B/A | D μm | D/A | Single drive (2) m/s | All drive (3) m/s | Rate of change % | Cross talk influence | Evaluation |
| * 1 | 0.254 | 1 | 0.065 | 0.25 | 7.0 | 5.7 | 18 | X | X |
| 2 | 0.339 | 1 | 0.115 | 0.34 | 7.0 | 6.3 | 10 | ○ | ◎ |
| 3 | 0.423 | 1 | 0.179 | 0.42 | 7.0 | 6.3 | 10 | ○ | ◎ |
| 4 | 0.847 | 1 | 0.717 | 0.85 | 7.0 | 6.3 | 10 | ○ | ◎ |
| 5 | 1.270 | 1 | 1.613 | 1.27 | 7.0 | 6.3 | 10 | ○ | ◎ |
| 6 | 2.540 | 1 | 6.452 | 2.54 | 7.0 | 6.3 | 10 | ○ | ○ |
| * 7 | 0.254 | 1 | 0.040 | 0.16 | 7.0 | 5.7 | 18 | X | X |
| 8 | 0.339 | 1 | 0.072 | 0.21 | 7.0 | 6.3 | 10 | ○ | ◎ |
| 9 | 0.423 | 1 | 0.112 | 0.26 | 7.0 | 6.3 | 10 | ○ | ◎ |
| 10 | 0.847 | 1 | 0.448 | 0.53 | 7.0 | 6.3 | 10 | ○ | ◎ |
| 11 | 1.270 | 1 | 1.008 | 0.79 | 7.0 | 6.3 | 10 | ○ | ◎ |
| 12 | 2.540 | 1 | 4.032 | 1.59 | 7.0 | 6.3 | 10 | ○ | ○ |
| * 13 | 0.296 | 0.7 | 0.066 | 0.16 | 7.0 | 4.9 | 30 | X | X |
| * 14 | 0.381 | 0.9 | 0.095 | 0.22 | 7.0 | 5.7 | 18 | X | X |
| 15 | 0.402 | 0.95 | 0.103 | 0.24 | 7.0 | 6.0 | 15 | ○ | ◎ |
| 16 | 0.423 | 1 | 0.112 | 0.26 | 7.0 | 6.3 | 10 | ○ | ◎ |
| 17 | 0.466 | 1.1 | 0.131 | 0.31 | 7.0 | 6.3 | 10 | ○ | ◎ |
| 18 | 0.508 | 1.2 | 0.151 | 0.36 | 7.0 | 6.3 | 10 | ○ | ◎ |
| 19 | 0.550 | 1.3 | 0.174 | 0.41 | 7.0 | 6.3 | 10 | ○ | ◎ |
| 20 | 0.593 | 1.4 | 0.198 | 0.47 | 7.0 | 6.3 | 10 | ○ | ◎ |
| 21 | 0.635 | 1.5 | 0.224 | 0.53 | 7.0 | 6.3 | 10 | ○ | ◎ |
| * 22 | 0.677 | 1.6 | 0.252 | 0.59 | 7.0 | 6.3 | 10 | ○ | X |
| * 23 | 0.212 | 1 | 0.028 | 0.13 | 7.0 | 5.6 | 20 | X | X |
| 24 | 0.282 | 1 | 0.050 | 0.18 | 7.0 | 6.3 | 10 | ○ | ◎ |
| 25 | 0.423 | 1 | 0.112 | 0.26 | 7.0 | 6.3 | 10 | ○ | ◎ |
| 26 | 0.847 | 1 | 0.448 | 0.53 | 7.0 | 6.3 | 10 | ○ | ◎ |
| 27 | 1.270 | 1 | 1.008 | 0.79 | 7.0 | 6.3 | 10 | ○ | ◎ |
| 28 | 2.540 | 1 | 4.032 | 1.59 | 7.0 | 6.3 | 10 | ○ | ○ |
| * 29 | 0.423 | 1 | 0.042 | 0.10 | 7.0 | 5.6 | 20 | X | X |
| 30 | 0.423 | 1 | 0.064 | 0.15 | 7.0 | 6.0 | 15 | ○ | ◎ |
| 31 | 0.423 | 1 | 0.085 | 0.20 | 7.0 | 6.3 | 10 | ○ | ◎ |
| 32 | 0.423 | 1 | 0.212 | 0.50 | 7.0 | 6.3 | 10 | ○ | ◎ |
| 33 | 0.423 | 1 | 0.318 | 0.75 | 7.0 | 6.3 | 10 | ○ | ◎ |
| 34 | 0.423 | 1 | 0.423 | 1.00 | 7.0 | 6.3 | 10 | ○ | ◎ |
| 35 | 0.423 | 1 | 0.529 | 1.25 | 7.0 | 6.3 | 10 | ○ | ◎ |
| 36 | 0.254 | 1.2 | 0.038 | 0.18 | 7.0 | 6.0 | 15 | ○ | ◎ |
| 37 | 0.305 | 1.2 | 0.055 | 0.21 | 7.0 | 6.1 | 13 | ○ | ◎ |
| 38 | 0.254 | 1.2 | 0.038 | 0.18 | 7.0 | 6.0 | 15 | ○ | ◎ |
| 39 | 0.305 | 1.2 | 0.055 | 0.21 | 7.0 | 6.1 | 13 | ○ | ◎ |

Sample marked "*" is out of the scope of the present invention.

Note:

(1) In Arrangement pattern, "L" means "Lattice pattern", and "H" means "Hound's-tooth check pattern".

(2) "Single drive" means discharge speed when one piezoelectric displacement element was driven alone.

(3) "All drive" means discharge speed when all piezoelectric displacement elements were driven at the same time.

As shown in Table 1, the samples Nos. 1, 7, 13, 14, 23 and 29 that are out of the scope of the present invention showed a large value of not less than 16% in the rate of change of discharge speed, and cross talk had large influence. The sample No. 22 had the ratio (B/A) of over 1.5, making it impossible to miniaturize printing heads.

On the contrary, the samples Nos. 2 to 6, Nos. 8 to 12, Nos. 15 to 22, Nos. 24 to 28 and Nos. 30 to 35 that are within the scope of the present invention showed a small value of not more than 15% in the rate of change of discharge speed, and cross talk had small influence. In particular, the samples Nos. 2 to 5, Nos. 8 to 11, Nos. 15 to 21, Nos. 24 to 27 and Nos. 30 to 35 showed a value of not less than 1.2 in the ratio (Y/X) of length Y in lateral direction to length X in longitudinal direction of the piezoelectric actuator, which can contribute to further miniaturization of printing heads.

What is claimed is:

1. A liquid discharge device comprising a piezoelectric actuator in which a plurality of piezoelectric displacement elements with a plurality of driving electrodes formed on a common piezoelectric ceramic layer are longitudinally and laterally disposed with regularity; and a flow passage member in which a plurality of liquid compressing chambers with liquid outlet orifices are formed, and on which the piezoelectric actuator is placed to cover said liquid compressing chambers, so that the driving electrodes correspond in position to the liquid compressing chambers, wherein the piezoelectric displacement elements are disposed longitudinally in N lines ($N \geqq 4$), having dot density of not less than 300 dpi in the lateral direction, showing 0.95 to 1.5 in the ratio (B/A) of arrangement interval B between the driving electrodes in the longitudinal direction to arrangement interval A between the driving electrodes in the lateral direction, and showing $D \geqq 0.15$ A in the minimum distance D between the neighboring driving electrodes.

2. The liquid discharge device according to claim 1, wherein dot density is not less than 600 dpi in the lateral direction.

3. The liquid discharge device according to claim 1, wherein the piezoelectric displacement elements are disposed longitudinally in number of lines N of 4 to 150.

4. The liquid discharge device according to claim 1, wherein the piezoelectric displacement elements are disposed at a rate of 20 to 120 pieces/inch in each line.

5. The liquid discharge device according to claim 4, wherein the piezoelectric displacement elements are disposed at a rate of 20 to 90 pieces/inch in each line.

6. The liquid discharge device according to claim 1, wherein the piezoelectric displacement elements are disposed in hound's-tooth check pattern and in the piezoelectric actuator the ratio (Y/X) of length Y in the lateral direction to length X in the longitudinal direction is not less than 1.2.

7. The liquid discharge device according to claim 6, having the ratio (Y/X) of not less than 2.

8. The liquid discharge device according to claim 1, wherein the piezoelectric actuator comprises a laminated body in which a common electrode, a piezoelectric ceramic layer and driving electrodes are laminated on a diaphragm in this order; and the piezoelectric displacement elements comprises the common electrode, the driving electrode and the piezoelectric ceramic layer between these electrodes.

9. The liquid discharge device according to claim 1, wherein a land part is prepared at one end of each driving electrode to connect external wiring for applying driving voltage.

10. The liquid discharge device according to claim 1, applied to a serial scan head.

11. The liquid discharge device according to claim 1, applied to a line scan head.

12. Recording apparatus having the liquid discharge device according to claim 1.

13. An ink-jet printing head comprising a piezoelectric actuator in which a plurality of piezoelectric displacement elements with a plurality of driving electrodes formed on a common piezoelectric ceramic layer are longitudinally and laterally disposed with regularity; and a flow passage member in which a plurality of liquid compressing chambers with liquid outlet orifices are formed, and on which the piezoelectric actuator is placed to cover said liquid compressing chambers, so that the driving electrodes correspond in position to the liquid compressing chambers, wherein the piezoelectric displacement elements are disposed longitudinally in N lines ($N \geqq 4$), having dot density of not less than 300 dpi in the lateral direction, showing 0.95 to 1.5 in the ratio (B/A) of arrangement interval B between the driving electrodes in the longitudinal direction to arrangement interval A between the driving electrodes in the lateral direction, and showing $D \geqq 0.15$ A in the minimum distance D between the neighboring driving electrodes.

* * * * *